US009885980B2

(12) United States Patent
Ui

(10) Patent No.: US 9,885,980 B2
(45) Date of Patent: Feb. 6, 2018

(54) IMAGE FORMATION APPARATUS

(71) Applicant: Konica Minolta, Inc., Tokyo (JP)

(72) Inventor: Makoto Ui, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/442,816

(22) Filed: Feb. 27, 2017

(65) Prior Publication Data

US 2017/0255130 A1 Sep. 7, 2017

(30) Foreign Application Priority Data

Mar. 4, 2016 (JP) ..... 2016-042200

(51) Int. Cl.
*G03G 21/16* (2006.01)
*G03G 15/08* (2006.01)

(52) U.S. Cl.
CPC ..... *G03G 15/0894* (2013.01); *G03G 21/168* (2013.01); *G03G 21/1623* (2013.01)

(58) Field of Classification Search
USPC ..... 399/258, 262, 107, 110, 121, 124
See application file for complete search history.

(56) References Cited

U.S. PATENT DOCUMENTS 4,873,541 A * 10/1989 Hirose ..... G03G 15/0131 399/121

FOREIGN PATENT DOCUMENTS

JP 2015232644 A 12/2015

* cited by examiner

*Primary Examiner* — Susan Lee
(74) *Attorney, Agent, or Firm* — Lucas & Mercanti, LLP

(57) ABSTRACT

The image formation apparatus includes a transport frame including a maximum front-to-back medium width passage area defined in an area between a first back side passage line and a first front side passage line, and allowing a continuous medium of a maximum front-to-back width to pass therethrough, and a minimum front-to-back medium width passage area defined in an area located inside the maximum front-to-back medium width passage area between a second back side passage line and a second front side passage line, and allowing a continuous medium of a minimum front-to-back width to pass therethrough, in a state where the transport frame is drawn out most frontward and a toner replenishment door is opened most wide downward, when the toner replenishment door is seen downward projectively, at least a portion of the first back side passage line being covered with the toner replenishment door.

6 Claims, 7 Drawing Sheets

IMAGE FORMATION APPARATUS

The entire disclosure of Japanese Patent Application No. 2016-042200 filed on Mar. 4, 2016, including description, claims, drawings, and abstract is incorporated herein by reference in its entirety.

BACKGROUND

Technological Field

The present invention relates to a developing device and image formation apparatus forming an image in an electrophotographic system. An image formation apparatus, regardless of whether it may be a color image formation apparatus or a monochrome image formation apparatus, includes a digital copier, a fax, a printer and a similar electrophotographic device, a recorder, a display device etc.

Description of the Related Art

An image formation apparatus of an electrophotographic system, such as a copier, a printer, a facsimile, and an MFP, supplies an electrostatic latent image formed on a photoreceptor with toner from a developing device to form a toner image. An electrophotographic image formation apparatus capable of forming an image on a continuous medium may be configured to allow a transport frame including a transport path to be drawn out. The transport frame may have not only the transport path but also a unit of an image forming unit etc. mounted thereon.

Note that the continuous medium means a medium larger as a sheet in length than a flat sheet that can be accommodated inside the body of an image formation apparatus (e.g., the A3 size), and includes a drop curtain, a flat sheet for a banner, a rolled sheet, a continuous sheet, and the like for example. The medium includes not only paper but also film and the like including any medium in the form of paper to be printed by the image formation apparatus.

The transport frame is drawn out when the apparatus has a paper jam, undergoes maintenance, has a path cleaned, or the like. Japanese Laid-Open Patent Publication No. 2015-232644 discloses a configuration which has a mechanism which cuts a continuous medium's upstream and downstream on a transport frame when the transport frame is drawn out.

SUMMARY

In cleaning the path, tacky paper which includes an adhesive layer such as a gluing agent in a continuous medium often has the glue adhering to an end of the transport path of the continuous medium of the transport frame. In that case, it is necessary to significantly frequently clean the end of the transport path. In a state where the transport frame is drawn out, a configuration is adopted in which in view of operability the transport path is partially or entirely exposed upward (or observable by the user).

In the image formation apparatus of the electrophotographic system, in order to perform image printing, a toner replenishment unit which replenishes the image forming unit with toner is required. In view of facilitating operation and maintenance, the image forming unit is provided above the transport frame, and the toner replenishment unit is disposed in a vicinity of the image forming unit.

For toner replenishment, a toner cartridge system is often adopted. A toner cartridge system means that a toner cartridge empty of toner is removed from the body of the image formation apparatus and a toner cartridge filled with toner is loaded into the body of the image formation apparatus.

An image formation apparatus capable of accommodating a continuous medium, in a normal state, has the continuous medium passed inside a machine including the transport frame. When the transport frame is drawn out, as has been set forth above, the continuous medium in the image formation apparatus has its upstream and downstream cut. Once the transport frame has been drawn out, the image formation apparatus is stopped from operating, and simultaneously, various maintenance, cleaning or the like may be performed. It is also sufficiently expected that a toner cartridge is simultaneously replaced with another.

In a state in which the transport frame is drawn out of the image formation apparatus, when an empty toner cartridge is extracted, a toner which scatters in a vicinity of the toner replenishment unit falls on the transport frame at a location which departs from the toner replenishment unit. In that case, in the image formation apparatus capable of accommodating a continuous medium, the following issues arise.

A toner falls on the medium cut on the upstream and downstream sides of the transport frame. When the user removes the medium on which the toner fell, the toner falls from the medium and would soil the location where the apparatus is installed (an issue 1).

When tacky paper including an adhesive layer such as a gluing agent is used, the toner which falls adheres to the glue adhering to an end of the transport path of the continuous medium. Subsequently, when the image formation apparatus resumes printing, a color is transferred to the continuous medium over a long period of time while the continuous medium is transported (issue 2).

When the glue adhering to an end of the transport path of the continuous medium is removed by using a rag or the like, the glue and a carrier included in the toner may damage the transport path and the image forming unit and there is a possibility of inviting degradation in image quality of the image formation apparatus (issue 3).

When a configuration is adopted in which the transport frame is drawable to an area in which the toner does not adhere to the transport frame, it is necessary to adopt a configuration to increase a transportation rail's travelling amount so that the transport frame can be moved. When this configuration is adopted, it is necessary to increase the transportation rail's rigidity and increase rigidity on the side of the image formation apparatus, which invites an increased cost for producing the image formation apparatus (issue 4).

The present image formation apparatus has been made in view of the above issues, and an object thereof is to provide an image formation apparatus that can suppress falling of a toner on a drawable transport frame (or a medium passing unit) in replacing a toner cartridge with another without inviting an increased production cost.

To achieve at least one of the above mentioned objects, an image formation apparatus reflecting one aspect of the present invention is an image formation apparatus of an electrophotographic system capable of forming an image on a continuous medium, comprising: a transport frame configuring a portion of a transport path of the continuous medium inside the image formation apparatus and drawable toward a front side of the image formation apparatus; a toner replenishment area provided over the transport frame and allowing at least one or more toner cartridges to be disposed therein, the one or more toner cartridges being replaceable by being drawn out toward the front side of the image formation apparatus; and a toner replenishment door capable of being opened and closed downward on the front side of the toner replenishment area.

A medium transportation direction of the continuous medium is a lateral direction which is orthogonal to a frontward and backward direction of the image formation apparatus, and the transport frame has a maximum front-to-back medium width passage area defined, in the frontward and backward direction, in an area between a first back side passage line and a first front side passage line, and allowing a continuous medium of a maximum front-to-back width to pass therethrough, and a minimum front-to-back medium width passage area defined, in the frontward and backward direction, in an area located inside the maximum front-to-back medium width passage area between a second back side passage line and a second front side passage line, and allowing a continuous medium of a minimum front-to-back width to pass therethrough.

In a state where the transport frame is drawn out most frontward and the toner replenishment door is opened most wide downward, when the toner replenishment door is seen downward projectively, at least a portion of the first back side passage line is covered with the toner replenishment door.

BRIEF DESCRIPTION OF THE DRAWINGS

The advantages and features provided by one or more embodiments of the invention will become more fully understood from the detailed description given hereinbelow and the appended drawings which are given by way of illustration only and thus are not intended as a definition of the limits of the present invention, and wherein.

DETAILED DESCRIPTION OF EMBODIMENTS

Hereinafter, an embodiment of the present invention will be described with reference to the drawings. However, the scope of the invention is not limited to the illustrated examples.

An image formation apparatus in an embodiment based on the present invention will be described hereinafter with reference to the drawings. Note that in any embodiment described hereafter, when numbers, amounts and the like are referred to, the present invention is not necessarily limited in scope thereto unless otherwise indicated. Identical and corresponding components and parts are identically denoted and may not be described repeatedly. Furthermore, the drawings are not shown in accordance with an actual dimensional ratio, and to help understanding a structure, there is a portion shown with a modified ratio to clarify the structure.

(Image Formation Apparatus 1)

Figure 1:
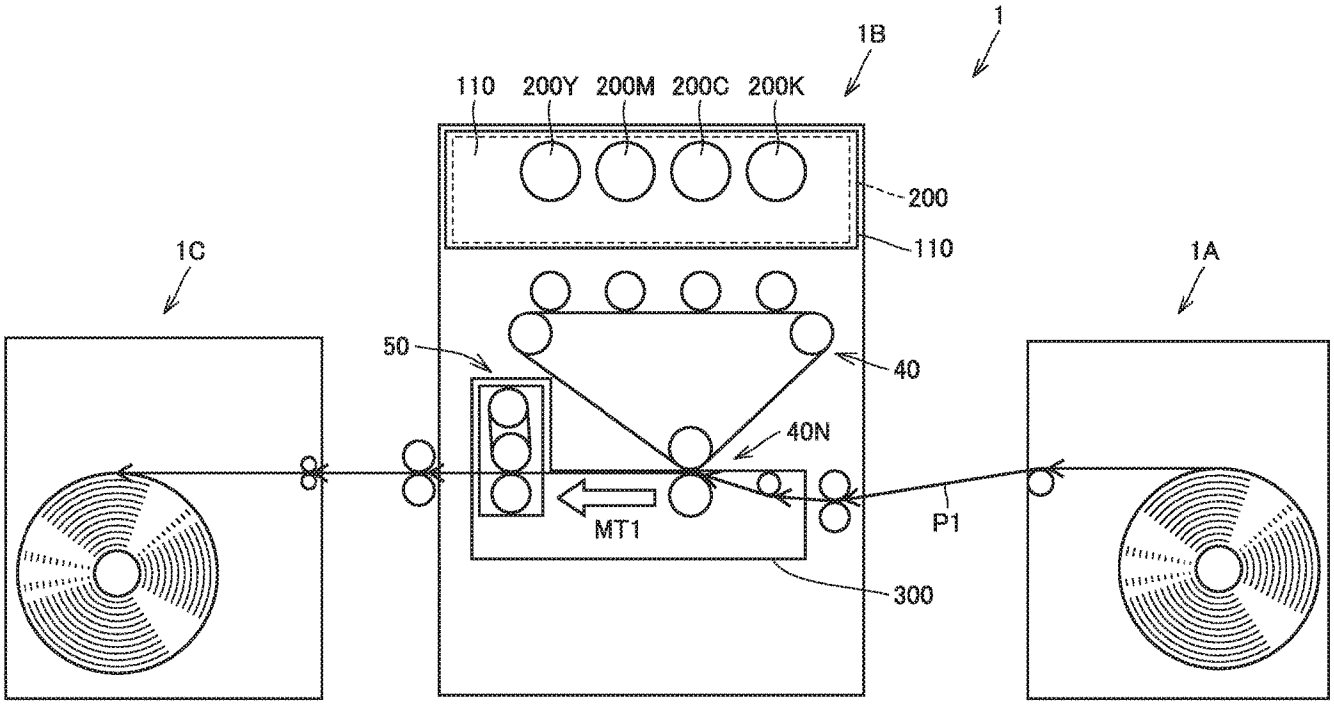
FIG. 1 is a schematic diagram showing a general configuration of an image formation apparatus of an embodiment.
Figure 2:
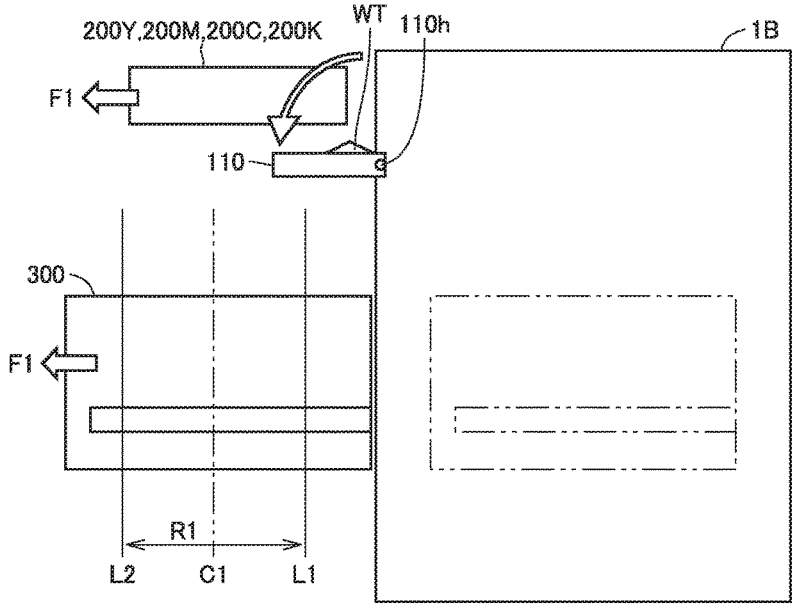
FIG. 2 is a side view showing a state where the image formation apparatus in the embodiment has a transport frame maximally drawn out frontward.

With reference to FIGS. 1 and 2, a schematic configuration of an image formation apparatus 1 in the present embodiment will be described. FIG. 1 is a schematic diagram showing a general configuration of image formation apparatus 1, and FIG. 2 is a side view showing a state where image formation apparatus 1 has a transport frame 300 maximally drawn out frontward.

Image formation apparatus 1 includes a sheet feeding device 1A, a main body 1B of the image formation apparatus, and a winding device 1C. Sheet feeding device 1A has a continuous medium P1 wound in the form of a roll, and continuous medium P1, after being fed from sheet feeding device 1A, passes along a transport path through main body 1B of the image formation apparatus, and after a prescribed image is formed, continuous medium P1 is wound up in winding device 1C in the form of a roll.

Inside main body 1B of the image formation apparatus, an image formation unit 40 and an image fixing unit 50 are provided, and they configure a portion of the transport path. In an image transfer unit 40N of image formation unit 40, an image formed in image formation unit 40 is transferred to continuous medium P1. The image transferred on continuous medium P1 is fixed by passing through image fixing unit 50.

Inside main body 1B of the image formation apparatus, transport frame 300 is provided which can be drawn out to the front side of main body 1B of the image formation apparatus when a paper jam occurs, for maintenance, for cleaning the path, and the like. As observed from a position at which the user stands who uses main body 1B of the image formation apparatus, a side closer to the user is referred to as a front side, a side farther from the user is referred to as a back side, and a rightward and leftward direction as seen from the user is referred to as a lateral direction. A medium transportation direction MT1 of continuous medium P1 will be a lateral direction W which is orthogonal to a frontward and backward direction D of main body 1B of the image formation apparatus.

Transport frame 300 is provided with a portion of image formation unit 40 and a portion of image fixing unit 50. Over transport frame 300, a toner replenishment area 200 is provided. In toner replenishment area 200, four types of toner cartridges 200Y, 200M, 200C, and 200K replaceable by being drawn out toward the front side of main body 1B of the image formation apparatus are disposed.

Toner cartridge 200Y is filled with a yellow toner, toner cartridge 200M is filled with a magenta toner, toner cartridge 200C is filled with a cyan toner, and toner cartridge 200K is filled with a black toner. The toner cartridges are selected in color type and number, as appropriate.

With reference to FIG. 2, on the front side of main body 1B of the image formation apparatus, in order to allow the above four types of toner cartridges 200Y, 200M, 200C, and 200K to be replaced, a toner replenishment door 110 which can be opened and closed downward is provided. Toner replenishment door 110 for example has its lower end portion pivotably attached to main body 1B of the image formation apparatus via a hinge 110*h* etc.

Toner cartridge 200Y, 200M, 200C, and 200K empty of toner, in a state where toner replenishment door 110 is opened, is drawn out frontward (in the figure, in a direction F1) and extracted from toner replenishment area 200 of main body 1B of the image formation apparatus. Subsequently, toner cartridge 200Y, 200M, 200C, and 200K filled with toner is loaded into toner replenishment area 200 of main body 1B of the image formation apparatus. Subsequently, toner replenishment door 110 is closed.

In FIG. 2, a state is shown in which transport frame 300 is drawn out to a frontmost side (in the figure, in direction F1), and toner replenishment door 110 is opened most wide downward. In the state in which toner replenishment door 110 is opened most wide downward, transport frame 300 will be located under toner replenishment door 110.

EXAMPLES

Hereinafter, reference will be made to FIGS. 3-7 to describe examples 1-5 having toner replenishment door 110 different in size. FIGS. 3-7 are plan views showing states where toner replenishment door 110 in examples 1-5 are opened frontward. In FIGS. 3-7, a state is shown in which transport frame 300 is drawn out to a frontmost side (in the figure, in direction F1), and toner replenishment door 110 is opened most wide downward. Combining the configurations in the examples as appropriate and thus using them is planned from the beginning.

In each figure, let an area defined, in frontward and backward direction D of main body 1B of the image formation apparatus, in an area between a first back side passage line L1 and a first front side passage line L2, and allowing continuous medium P1 of a maximum front-to-back width to pass therethrough be a maximum front-to-back medium width passage area R1.

Let an area defined, in frontward and backward direction D, in an area located inside maximum front-to-back medium width passage area R1 between a second back side passage line L3 and a second front side passage line L4, and allowing continuous medium P1 of a minimum front-to-back width to pass therethrough, be a minimum front-to-back medium width passage area R2.

While in the present example a center line C1 between first back side passage line L1 and first front side passage line L2, and center line C1 of second back side passage line L3 and second front side passage line L4 are positionally identical, they are not limited to this configuration. For example, second front side passage line L4 and first front side passage line L2 may overlap so that the center line between first back side passage line L1 and first front side passage line L2 may be closer to body B1 of the image formation apparatus than the center line of second back side passage line L3 and second front side passage line L4.

Example 1

Figure 3:
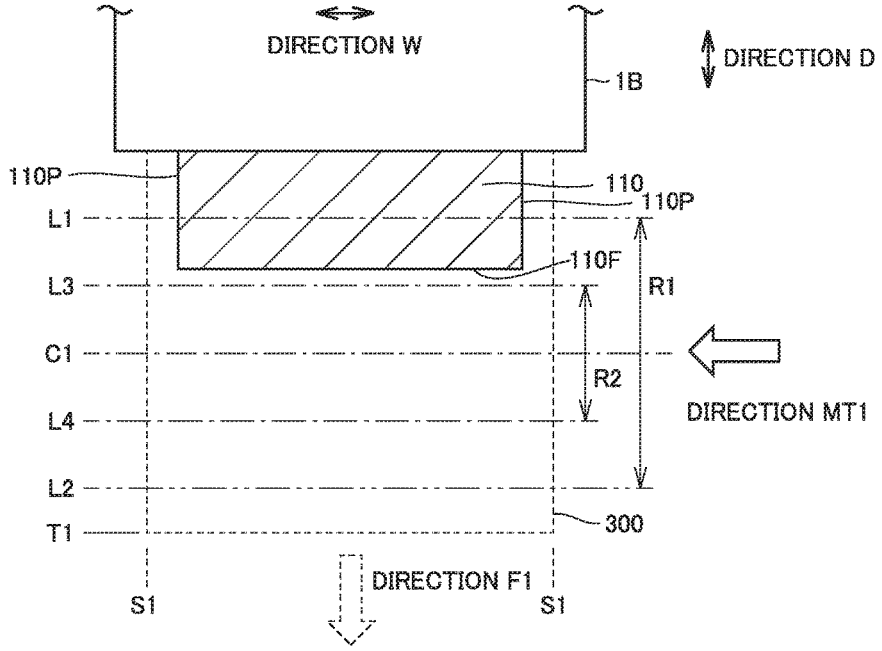
FIG. 3 is a plan view showing a state where a toner replenishment door in a first example is opened frontward.

With reference to FIG. 3, in this example, when toner replenishment door 110 is seen downward projectively, at least a portion of first back side passage line L1 is covered with toner replenishment door 110. Specifically, toner replenishment door 110 has opposite side surfaces 110P located inwardly of a line S1 of right and left side portions of transport frame 300, and toner replenishment door 110 has an end surface located between first back side passage line L1 and second back side passage line L3.

According to this configuration, in a state where toner replenishment door 110 is opened, at least a portion of first back side passage line L1 will be covered with toner replenishment door 110. As a result, as shown in FIG. 2, toner WT which falls from toner cartridges 200Y, 200M, 200C, and 200K when they are replaced with another falls on toner replenishment door 110.

It is believed that toner WT which falls from toner cartridges 200Y, 200M, 200C, and 200K when they are replaced with another has much thereof falling on a side closer to main body 1B of the image formation apparatus. As a result, adhesion of the toner to transport frame 300 on the side of first back side passage line L1 can be suppressed.

Example 2

Figure 4:
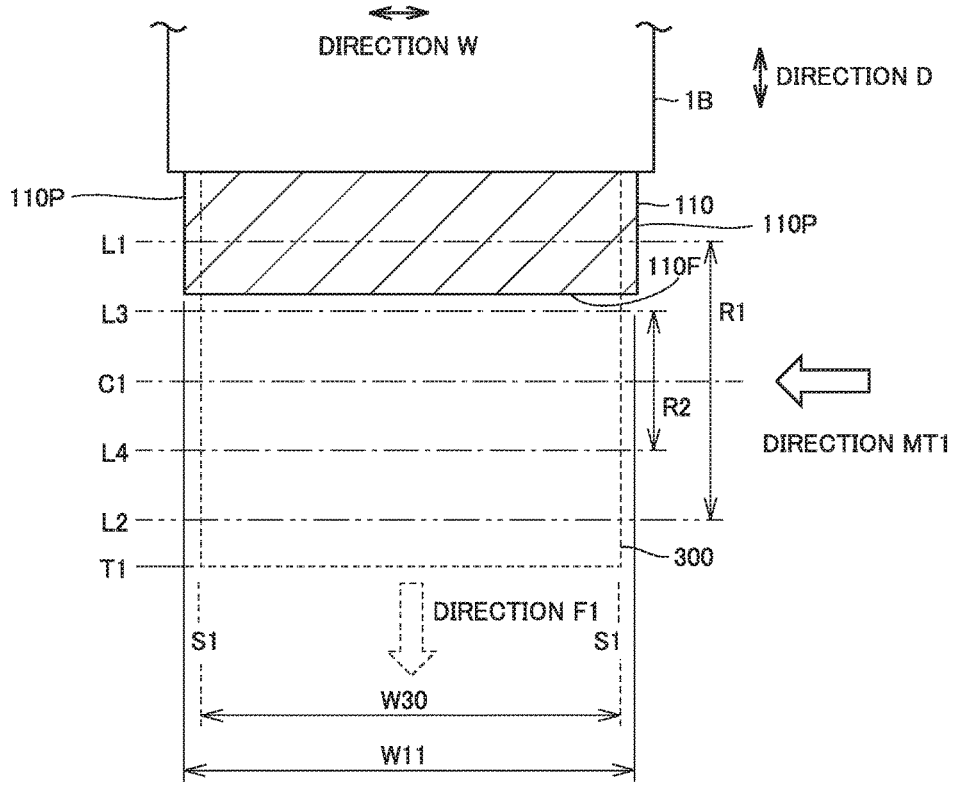
FIG. 4 is a plan view showing a state where a toner replenishment door in a second example is opened frontward.

With reference to FIG. 4, in this example, when toner replenishment door 110 is seen downward projectively, toner replenishment door 110 has a lateral width W11 including a lateral width W30 of transport frame 300, and when toner replenishment door 110 is seen downward projectively, first back side passage line L1 is entirely covered with toner replenishment door 110.

Specifically, toner replenishment door 110 has opposite side surfaces 110P located outwardly of line S1 of the right and left side portions of transport frame 300, and toner replenishment door 110 has an end surface located between first back side passage line L1 and second back side passage line L3.

According to this configuration, in a state where toner replenishment door 110 is opened, first back side passage line L1 will entirely be covered with toner replenishment door 110. As a result, as shown in FIG. 2, toner WT which falls from toner cartridges 200Y, 200M, 200C, and 200K when they are replaced with another falls on toner replenishment door 110.

As a result, adhesion of the toner to transport frame 300 on the side of first back side passage line L1 can be suppressed more than in the configuration of example 1.

Example 3

Figure 5:
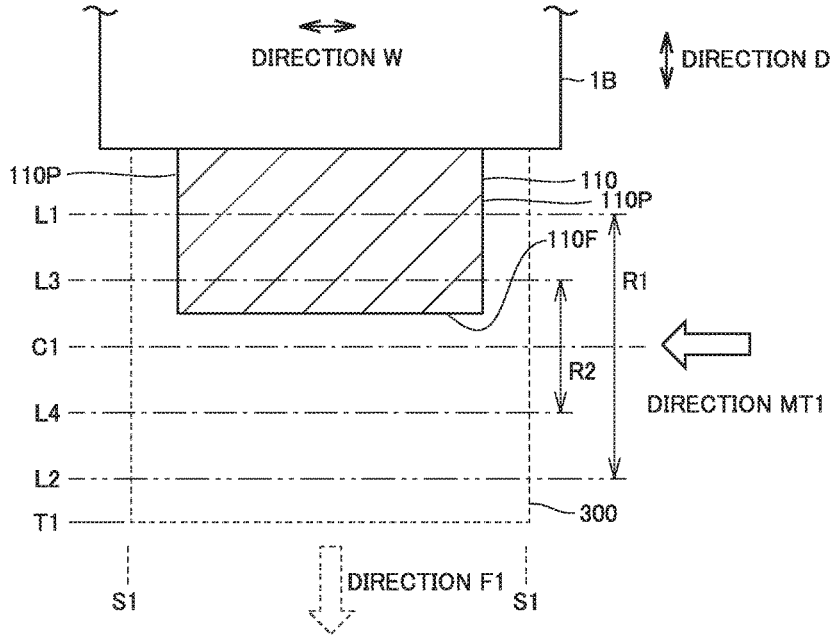
FIG. 5 is a plan view showing a state where a toner replenishment door in a third example is opened frontward.

With reference to FIG. 5, in this example, when toner replenishment door 110 is seen downward projectively, at least a portion of second back side passage line L3 is covered with toner replenishment door 110. Specifically, toner replenishment door 110 has opposite side surfaces 110P located inwardly of line S1 of the right and left side portions of transport frame 300, and toner replenishment door 110 covers a portion of first back side passage line L1 and that of second back side passage line L3, and toner replenishment door 110 has an end surface located between second back side passage line L3 and center line C1.

According to this configuration, in a state where toner replenishment door 110 is opened, at least a portion of first back side passage line L1 and that of second back side passage line L3 will be covered with toner replenishment door 110. As a result, as shown in FIG. 2, toner WT which falls from toner cartridges 200Y, 200M, 200C, and 200K when they are replaced with another falls on toner replenishment door 110.

It is believed that toner WT which falls from toner cartridges 200Y, 200M, 200C, and 200K when they are replaced with another has much thereof falling on a side closer to main body 1B of the image formation apparatus. As a result, adhesion of the toner to transport frame 300 on the side of first back side passage line L1 and second back side passage line L3 can be suppressed.

Example 4

Figure 6:
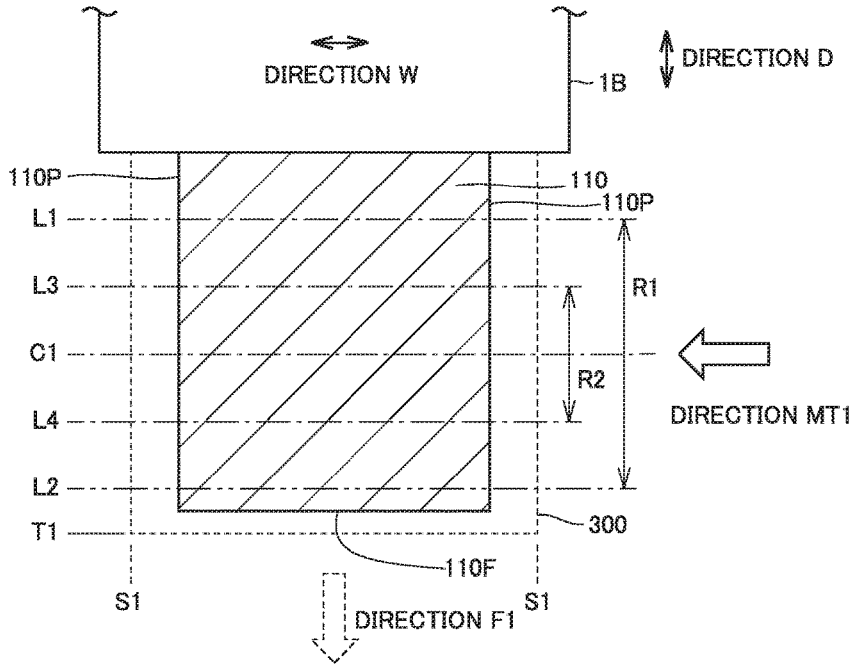
FIG. 6 is a plan view showing a state where a toner replenishment door in a fourth example is opened frontward.

With reference to FIG. 6, in this example, when toner replenishment door 110 is seen downward projectively, at least a portion of first front side passage line L2 is covered with toner replenishment door 110. Specifically, toner replenishment door 110 has opposite side surfaces 110P located inwardly of line S1 of the right and left side portions of transport frame 300, and toner replenishment door 110 covers a portion of first back side passage line L1, a portion of second back side passage line L3, a portion of second front side passage line L4, and a portion of first front side passage line L2, and toner replenishment door 110 has an end surface located between first front side passage line L2 and an end line T1 of transport frame 300.

According to this configuration, in a state where toner replenishment door 110 is opened, at least a portion of first back side passage line L1, a portion of second back side passage line L3, a portion of second front side passage line L4, and a portion of first front side passage line L2 will be covered with toner replenishment door 110. As a result, as shown in FIG. 2, toner WT which falls from toner cartridges 200Y, 200M, 200C, and 200K when they are replaced with another falls on toner replenishment door 110.

As a result, adhesion of the toner to transport frame 300 on the side of a portion of second front side passage line L4 and first front side passage line L2 can be suppressed more than in the configuration of example 3.

Example 5

Figure 7:
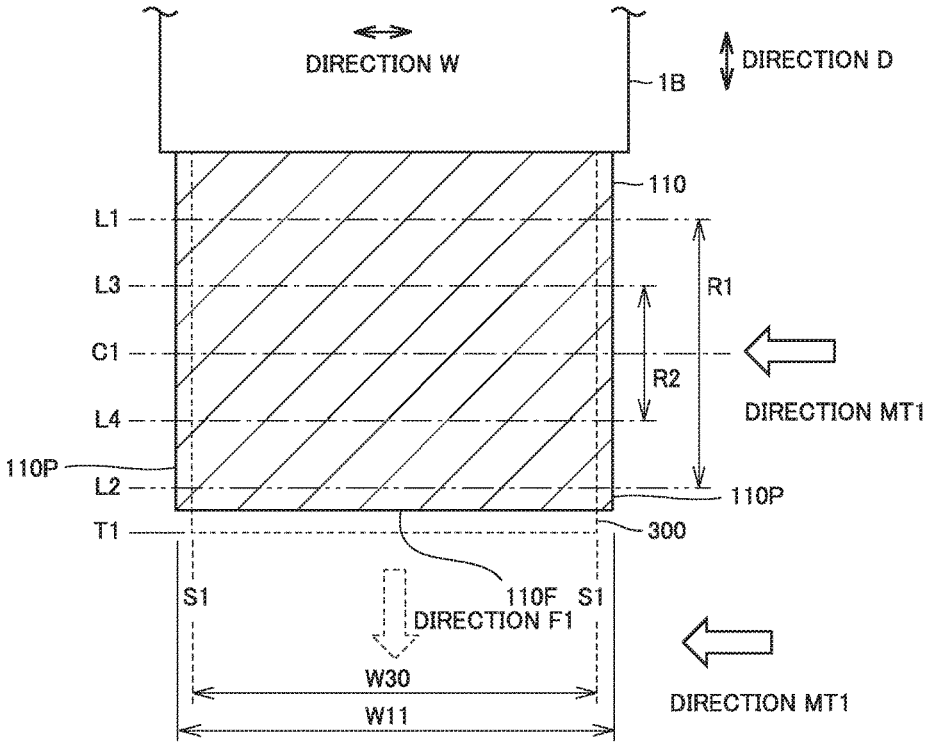
FIG. 7 is a plan view showing a state where a toner replenishment door in a fifth example is opened frontward.

With reference to FIG. 7, in this example, when toner replenishment door 110 is seen downward projectively, toner replenishment door 110 has lateral width W11 including lateral width W30 of transport frame 300, and when toner replenishment door 110 is seen downward projectively, first front side passage line L2 is entirely covered with toner replenishment door 110.

Specifically, toner replenishment door 110 has opposite side surfaces 110P located outwardly of line S1 of the right and left side portions of transport frame 300, and toner replenishment door 110 covers first back side passage line L1, second back side passage line L3, second front side passage line L4, and first front side passage line L2 entirely, and toner replenishment door 110 has an end surface located between first front side passage line L2 and end line T1 of transport frame 300.

According to this configuration, in a state where toner replenishment door 110 is opened, maximum front-to-back medium width passage area R1 and minimum front-to-back medium width passage area R2 of transport frame 300 are all covered with toner replenishment door 110. As a result, as shown in FIG. 2, toner WT which falls from toner cartridges 200Y, 200M, 200C, and 200K when they are replaced with another falls on toner replenishment door 110.

As a result, adhesion of the toner to transport frame 300 can be suppressed more than in the configuration of example 4.

Furthermore, there is also an image formation apparatus which includes a carrier (an organic solvent) in a toner. A falling toner falls for example on first back side passage line L1 and the toner and the carrier adhere to the glue that the medium has. In cleaning, when a rag etc. infiltrated with alcohol etc. is used, the carrier easily causes a flaw. Furthermore, this has a more significant effect when the transport frame includes an image formation unit such as a transfer unit, and it not only has an effect on a medium to be subsequently printed but also results in an unsatisfactory image and it may be necessary to replace a part with another.

In contrast, the image formation apparatus in the present embodiment, even in a case where its toner includes a carrier (an organic solvent), allows a portion of first back side passage line L1, on which the toner most easily falls, to be covered with toner replenishment door 110, and can also avoid an effect on the medium, and an unsatisfactory image.

Thus, according to the image formation apparatus in the present embodiment and each example, toner replenishment door 110 used for opening and closing toner replenishment area 200 can be used to cover transport frame 300 to receive a toner that falls from a toner cartridge to suppress adhesion of the toner to transport frame 300. Using toner replenishment door 110 used for opening and closing toner replenishment area 200 does not invite an increased production cost.

The present image formation apparatus is an image formation apparatus of an electrophotographic system capable of forming an image on a continuous medium, comprising: a transport frame configuring a portion of a transport path of the continuous medium inside the image formation apparatus and drawable toward a front side of the image formation apparatus; a toner replenishment area provided over the transport frame and allowing at least one or more toner cartridges to be disposed therein, the one or more toner cartridges being replaceable by being drawn out toward the front side of the image formation apparatus; and a toner replenishment door provided to the image formation apparatus and capable of being opened and closed downward on the front side of the toner replenishment area.

A medium transportation direction of the continuous medium is a lateral direction which is orthogonal to a frontward and backward direction of the image formation apparatus, and the transport frame has a maximum front-to-back medium width passage area defined, in the frontward and backward direction, in an area between a first back side passage line and a first front side passage line, and allowing a continuous medium of a maximum front-to-back width to pass therethrough, and a minimum front-to-back medium width passage area defined, in the frontward and backward direction, in an area located inside the maximum front-to-back medium width passage area between a second back side passage line and a second front side passage line, and allowing a continuous medium of a minimum front-to-back width to pass therethrough.

In a state where the transport frame is drawn out most frontward and the toner replenishment door is opened most wide downward, when the toner replenishment door is seen downward projectively, at least a portion of the first back side passage line is covered with the toner replenishment door.

In another form, when the toner replenishment door is seen downward projectively, the first back side passage line on the transport frame is entirely covered with the toner replenishment door.

In another form, when the toner replenishment door is seen downward projectively, at least a portion of the second back side passage line is covered with the toner replenishment door.

In another form, when the toner replenishment door is seen downward projectively, at least a portion of the first front side passage line is covered with the toner replenishment door.

In another form, when the toner replenishment door is seen downward projectively, the first front side passage line on the transport frame is entirely covered with the toner replenishment door.

In another form, the toner replenishment door has a width in the lateral direction larger than a lateral width of the transport frame.

According to the present image formation apparatus a toner replenishment door used for opening and closing a toner replenishment area can be used to cover a transport frame to receive a toner that falls from a toner cartridge to suppress adhesion of the toner to the transport frame. Using the toner replenishment door used for opening and closing the toner replenishment area does not invite an increased production cost.

Although embodiments of the present invention has been described and illustrated in detail, it is clearly understood that the same is by way of illustrated and example only and is not to be taken by way of limitation and the scope of the present invention is interpreted by terms of the appended claims.

What is claimed is:

1. An electrophotographic image formation apparatus capable of forming an image on a continuous medium, comprising:

a transport frame configuring a portion of a transport path of the continuous medium inside the image formation apparatus and drawable toward a front side of the image formation apparatus;

a toner replenishment area provided over the transport frame and allowing at least one or more toner cartridges to be disposed therein, the at least one or more toner cartridges being replaceable by being drawn out toward the front side of the image formation apparatus; and a toner replenishment door capable of being opened and closed downward on the front side of the toner replenishment area, a medium transportation direction of the continuous medium being a lateral direction orthogonal to a frontward and backward direction of the image formation apparatus, the transport frame including a maximum front-to-back medium width passage area defined, in the frontward and backward direction, in an area between a first back side passage line and a first front side passage line, and allowing a continuous medium of a maximum front-to-back width to pass therethrough, and a minimum front-to-back medium width passage area defined, in the frontward and backward direction, in an area located inside the maximum front-to-back medium width passage area between a second back side passage line and a second front side passage line, and allowing a continuous medium of a minimum front-to-back width to pass therethrough, in a state where the transport frame is drawn out most frontward and the toner replenishment door is opened most wide downward, when the toner replenishment door is seen downward projectively, at least a portion of the first back side passage line being covered with the toner replenishment door.

2. The image formation apparatus according to claim 1, wherein when the toner replenishment door is seen downward projectively, the first back side passage line on the transport frame is entirely covered with the toner replenishment door.

3. The image formation apparatus according to claim 1, wherein when the toner replenishment door is seen downward projectively, at least a portion of the second back side passage line is covered with the toner replenishment door.

4. The image formation apparatus according to claim 1, wherein when the toner replenishment door is seen downward projectively, at least a portion of the first front side passage line is covered with the toner replenishment door.

5. The image formation apparatus according to claim 1, wherein when the toner replenishment door is seen downward projectively, the first front side passage line on the transport frame is entirely covered with the toner replenishment door.

6. The image formation apparatus according to claim 1, wherein the toner replenishment door has a width in the lateral direction larger than a lateral width of the transport frame.

* * * * *